US011792565B2

(12) United States Patent
Lin et al.

(10) Patent No.: US 11,792,565 B2
(45) Date of Patent: Oct. 17, 2023

(54) ELECTRONIC MODULE

(71) Applicant: Advanced Semiconductor Engineering, Inc., Kaohsiung (TW)

(72) Inventors: Chih Lung Lin, Kaohsiung (TW); Kuei-Hao Tseng, Kaohsiung (TW); Kai Hung Wang, Kaohsiung (TW)

(73) Assignee: ADVANCED SEMICONDUCTOR ENGINEERING, INC., Kaohsiung (TW)

( * ) Notice: Subject to any disclaimer, the term of this patent is extended or adjusted under 35 U.S.C. 154(b) by 0 days.

(21) Appl. No.: 17/242,060

(22) Filed: Apr. 27, 2021

(65) Prior Publication Data

US 2022/0345811 A1 Oct. 27, 2022

(51) Int. Cl.

| | |
|---|---|
| ***H04R 1/24*** | (2006.01) |
| ***H04R 1/40*** | (2006.01) |
| ***H04R 3/12*** | (2006.01) |
| ***H04R 1/26*** | (2006.01) |

(52) U.S. Cl.

CPC ..... *H04R 1/403* (2013.01); *H04R 1/24* (2013.01); *H04R 1/26* (2013.01); *H04R 3/12* (2013.01); *H04R 2201/405* (2013.01); *H04R 2430/20* (2013.01)

(58) Field of Classification Search

CPC ..... H04R 2430/20; H04R 1/26; H04R 1/403; H04R 3/12; H04R 1/24

USPC ..... 381/77–85, 304–305

See application file for complete search history.

(56) References Cited

U.S. PATENT DOCUMENTS

| | | | | |
|---|---|---|---|---|
| 8,208,970 | B2 * | 6/2012 | Cheung | H04M 1/03 381/191 |
| 8,538,036 | B2 * | 9/2013 | Pompei | H04R 5/02 381/77 |
| 8,750,541 | B1 | 6/2014 | Dong et al. | |
| 8,934,654 | B2 * | 1/2015 | Fullam | H04R 1/028 381/387 |
| 9,036,856 | B2 * | 5/2015 | Takeda | H04S 7/303 381/387 |
| 10,564,675 | B2 * | 2/2020 | Ka | G06F 3/1423 |
| 10,728,651 | B2 | 7/2020 | Rusconi Clerici Beltrami et al. | |
| 11,146,894 | B2 * | 10/2021 | Brioschi | B81B 7/0061 |
| 11,256,470 | B1 * | 2/2022 | Adoni | H04R 1/403 |
| 11,257,508 | B2 * | 2/2022 | Cheung | G10L 21/0208 |

FOREIGN PATENT DOCUMENTS

CN 102404664 A 4/2012

OTHER PUBLICATIONS

Office Action for corresponding Taiwan Patent Application No. 111115489, dated Aug. 17, 2023, 5 pages.

Search Report with English translation for corresponding Taiwan Patent Application No. 111115489, dated Aug. 17, 2023, 3 pages.

* cited by examiner

*Primary Examiner* — Disler Paul

(74) *Attorney, Agent, or Firm* — FOLEY & LARDNER LLP

(57) ABSTRACT

An electronic module is provided. The electronic module includes a first transducer and a second transducer. The first transducer is configured to radiate a first ultrasonic wave. The second transducer is configured to radiate a second ultrasonic wave. A location of the first transducer is configured to be adjustable with respect to the second transducer.

14 Claims, 6 Drawing Sheets

ELECTRONIC MODULE

BACKGROUND

1. Technical Field

The present disclosure relates to an electrical device, and more particularly to an audio device including transducers.

2. Description of the Related Art

An electrical device (e.g., an earphone, a speaker, an audio player, a portable device, or so on) may be equipped with sound generating units for multiple purposes. Sound generating units can generate sonic waves that are audible for users. Conventionally, these sonic waves are omnidirectional. Thus, when a user plays audio data using a conventional electrical device, the sound generated by the sound generating units of that electronic device is projected outward from the electrical device in various directions to be heard by people other than the user.

SUMMARY

In accordance with some arrangement of the present disclosure, an electronic module includes a first transducer and a second transducer. The first transducer is configured to radiate a first ultrasonic wave. The second transducer is configured to radiate a second ultrasonic wave. A location of the first transducer is configured to be adjustable with respect to the second transducer.

In accordance with some arrangement of the present disclosure, an electronic module includes an adjustable carrier, a first transducer, and a second transducer. The first transducer is disposed on the adjustable carrier and configured to radiate a first ultrasonic wave. The second transducer is disposed on the adjustable carrier configured to radiate a second ultrasonic wave.

In accordance with some arrangement of the present disclosure, a method of forming a sound wave includes providing an adjustable carrier on which a plurality of transducers are disposed, the transducers configured to generate respective ultrasonic waves; and adjusting relative locations of the transducers on the adjustable substrate to form the sound wave demodulated from the ultrasonic waves.

Figure 1:
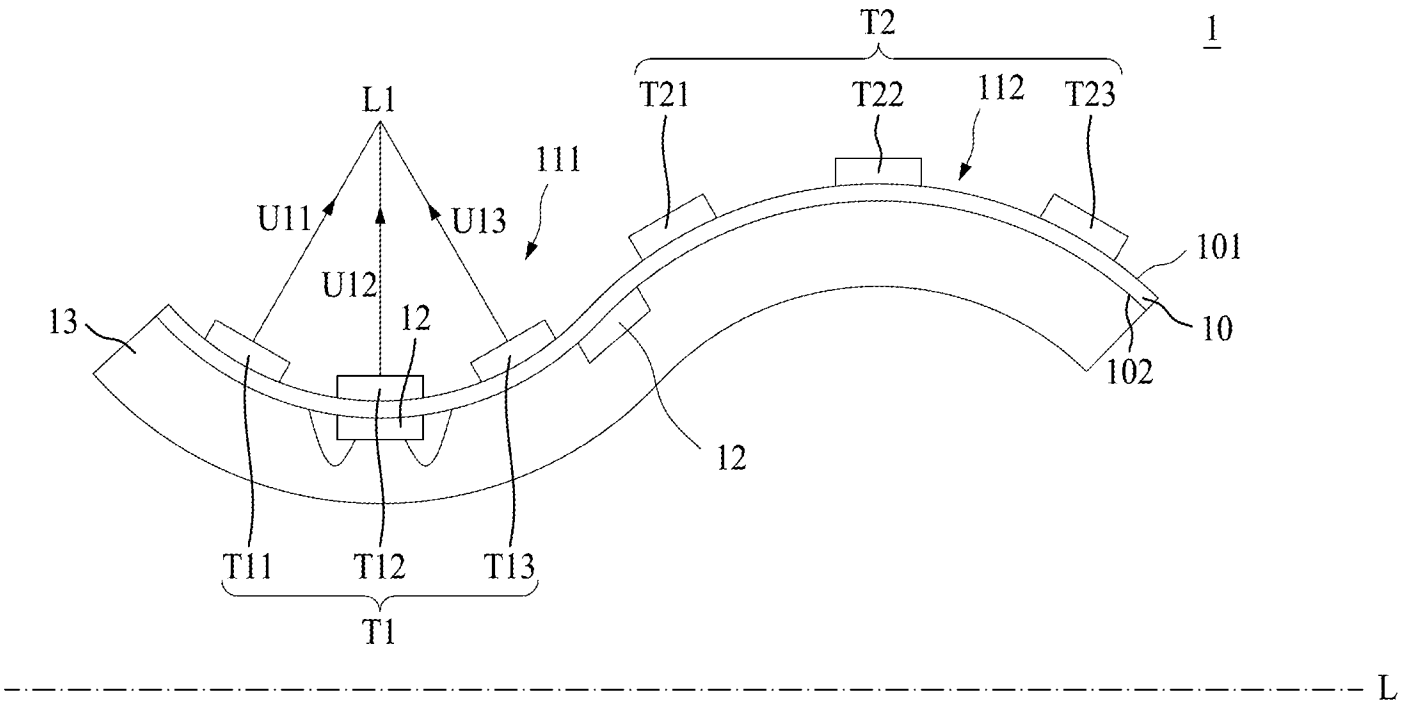
FIG. 1 illustrates a cross-sectional view of an electronic module, in accordance with some arrangement of the present disclosure.

Common reference numerals are used throughout the drawings and the detailed description to indicate the same or similar components. The present disclosure will be readily understood from the following detailed description taken in conjunction with the accompanying drawings.

DETAILED DESCRIPTION

Arrangements disclosed herein relate to systems, apparatuses, and methods for providing an electronic device that can generate directional sonic waves for one or more specific users of the electronic device. FIG. 1 illustrates a cross-sectional view of an electronic module 1, in accordance with some arrangement of the present disclosure. The electronic module 1 includes a substrate 10, one or more sets of transducers T1, T2, an electronic component 12, and a package body 13. In some arrangement, the electronic module 1 may be included in an electrical device that can be configured to generate audio information for at least one user of the electronic device. Said electrical device may be (or include) a cellular phone, a desktop computer, a laptop computer, a personal digital assistant (PDA), a tablet computer, a television, a wearable device (e.g., an earphone, a smart watch, a smart band, smart glasses), a speaker, a telephone, or so on.

The substrate (or carrier) 10 may be or include, for example, one or more of a printed circuit board, such as a paper-based copper foil laminate, a composite copper foil laminate, a polymer-impregnated glass-fiber-based copper foil laminate, and so on. The substrate 10 may include an interconnection structure, such as a redistribution layer (RDL) and/or a grounding element. In some arrangement, the substrate 10 includes pliable materials. An outline or shape of the substrate 10 may be configured to be adjustable or pliable. For example, the outline of the substrate 10 is pliable, flexible, bendable, and/or twistable. For example, the substrate 10 can be adjusted or bent to have a shape that conforms to any structure (e.g., a straight/flat or a non-straight/non-flat structure) of the electrical device. In some arrangement, the substrate 10 may include a flexible printed circuit (FPC). As shown in FIG. 1, a cross-section of the substrate 10 has a wave or "S" shape.

The substrate 10 has a surface 101 and a surface 102 opposite to the surface 101. As shown in FIG. 1, the substrate 10 is adjusted (e.g., bent) to have curved surfaces (e.g., the surface 101 and the surface 102). Each of the surface 101 or the surface 102 of the substrate 10 has a wave or "S" shape and has a concave portion 111 and a convex portion 112. For example, the surface 101 has the concave portion 111 on which the set of transducers T1 is disposed and the convex portion 112 on which the set of transducers T2 is disposed. In that regard, a portion of the concave portion 111 of the surface faces and contacts each transducer in the set of transducers T1, and a portion of the convex portion 112 of the surface faces and contacts each transducer in the set of transducers T2. The convex portion 112 and the concave portion 111 of the surface 101 are adjacent to one another. In other arrangement, the substrate 10 may be adjusted (e.g., bent) to have any other shapes depending on different requirements.

The set of transducers T1 may include one or more transducers such as transducers T11, T12, and T13. The set of transducers T2 may include one or more transducers such as transducers T21, T22, and T23. The transducers T11, T12, T13, T21, T22, and T23 are disposed on the surface 101 of the substrate 10. In some arrangement, the locations of the transducers T11, T12, T13, T21, T22, and T23 is configured to be adjustable, and the relative positions of the transducers T11, T12, T13, T21, T22, and T23 are adjustable by adjusting the shape of the substrate 10. For example, when the shape of the substrate 10 is adjusted (e.g., bent or twisted), the relative positions of the transducers T11, T12, T13, T21, T22, and T23 can be changed as a result of the shape of the substrate 10 being adjusted. In some arrangement, as shown in FIG. 1, the substrate 10 is bent so that the surface 101 (and the surface 102) forms the concave portion 111 and the convex portion 112, where the concave portion 111 bends toward one direction and the convex portion 112 bends toward an opposite direction. The transducers T11, T12, T13, T21, T22, and T23 are disposed on a noncoplanar surface (e.g., the surface 101). The transducers T11, T12, T13, T21, T22, and T23 are arranged on different surfaces (e.g., different portions of the surface 101) that are noncoplanar. For example, the transducers T11, T12, and T13 are disposed on the concave portion 111 of the surface 101 of the substrate 10. The transducers T21, T22, and T23 are disposed on the convex portion 112 of the surface 101 of the substrate 10. In other arrangement, the substrate 10 may be adjusted (bent) so that the surface 101 has a concave portion (e.g., the concave portion 101) on which some of the transducers (e.g., the first set of transducers T1) are disposed and a straight/flat portion on which the rest of the transducers (e.g., the second set of transducers T2) are disposed. In some embodiments, the transducers T11, T12, T13, T21, T22, and T23 are electrically connected to the substrate through, for example, flip-chip, wire bonding, or any other suitable techniques. As shown in FIG. 1, at least some of the transducers T11, T12, T13, T21, T22, and T23 may have different elevations relative to a reference line L, where the reference line L is parallel to a line denoting an average of the cross section of the surface 101 or an line denoting an average of the cross section of the surface 102. For example, normal lines that are normal to surfaces on which the transducers T11, T12, and T13 are disposed are non-parallel to each other. For example, normal lines that are normal to surfaces on which the transducers T21, T22, and T23 are disposed are non-parallel to each other. For example, the normal lines of the surfaces on which the transducers T11, T12, and T13 are disposed may intersect with one another. For example, the normal lines of the surfaces on which the transducers T21, T22, and T23 are disposed may intersect with one another.

In some arrangement, each of the transducers T11, T12, T13, T21, T22, and T23 can be configured to emit (radiate or transmit) sonic waves. For example, each of the transducers T11, T12, T13, T21, T22, and T23 can be configured to radiate audible sonic waves (or acoustic waves, which can be audible to bodies including humans or animals) or ultrasonic waves. For example, each of the transducers T11, T12, T13, T21, T22, and T23 can be controlled by, for example, an electronic component (e.g., one of the electronic components 12) to radiate audible sonic waves or ultrasonic waves depending on its locations. In some arrangements, as shown in FIG. 1, the transducers T21, T22, and T23 (which are located at the convex portion 112 of the surface 101 of the substrate) are configured to radiate sonic waves audible to bodies or creatures (e.g., humans or animals). For example, the transducers T21, T22, and T23 are configured to radiate sonic waves with frequencies in a range from about 20 Hz to about 20 kHz. For example, the transducers T21, T22, and T23 are configured to radiate omnidirectional sonic waves. In other words, the sound generated by the transducers T21, T22, and T23 can be heard by bodies at any position around the electronic module 1.

In some arrangements, as shown in FIG. 1, the transducers T11, T12, and T13 (which are located at the concave portion 111 of the surface 101 of the substrate) are configured to radiate ultrasonic waves U11, U12, and U13, respectively. For example, each of the ultrasonic waves U11, U12, and U13 has a frequency higher than the upper audible limit of human hearing (e.g., 20 kHz). In some arrangement, each of the ultrasonic waves U11, U12, and U13 has a frequency higher than 20 kHz. In some arrangement, each of the ultrasonic waves U11, U12, and U13 is directional, and the emission directions of the ultrasonic waves U11, U12, and U13 are non-parallel to each other. For example, the ultrasonic waves U11, U12, and U13 may be directed toward a same location L1 and may intersect at said location L1. In some arrangement, the location L1 may be a center of curvature of the concave portion 111 of the surface 101 of the substrate 10. In such arrangements, the lines representing the ultrasonic waves U11, U12, and U13 are radii of the curvature of the concave portion 111 of the surface 101. In other arrangement, the location L1 is different from the center of curvature of the concave portion 111 of the surface 101 of the substrate 10. In some arrangement, each of the ultrasonic waves U11, U12, and U13 is substantially perpendicular to a tangent line of the surface on which the corresponding one of the transducers T11, T12, and T13 is disposed. In other arrangement, each of the ultrasonic waves U11, U12, and U13 is not perpendicular to a tangent line of the surface on which the corresponding one of the transducers is disposed T11, T12, and T13.

The ultrasonic waves U11, U12, and U13 interfere with each other at or adjacent to a given location, for example, the location L1. The ultrasonic waves U11, U12, and U13 are demodulated at or adjacent to a given location, for example, the location L1 to form a sonic wave audible to a human (e.g., having a frequency between about 20 Hz to about 20 kHz) or an animal. For example, the ultrasonic waves U11, U12, and U13 are transmitted toward a predetermined region (e.g., the location L1), and thus the ultrasonic waves U11, U12, and U13 can interfere with each other to generate audible sound waves (which are audible to a human or an animal) having a frequency substantially equal to a difference between the frequencies of two of the ultrasonic waves U11, U12, and U13. In particular, the transducers T11, T12, and T13 can modulate the audio data/information into the ultrasonic waves U11, U12, and U13 and radiate the ultrasonic waves U11, U12, and U13 through the air from a parametric array. The parametric array radiates ultrasonic waves with a relatively high intensity and/or sound pressure level (SPL) (e.g., an SPL of around 120 dB or greater) and utilizes the non-linear characteristic of air to distort and demodulate the ultrasonic waves U11, U12, and U13 as the ultrasonic waves U11, U12, and U13 are converted t into audible sound waves as the ultrasonic waves U11, U12, and U13 travel through air. Each of the ultrasonic waves U11, U12, and U13 has relatively higher frequency and shorter wavelength as compared to the frequency and wavelength of audible sound waves, which allows the ultrasonic waves U11, U12, and U13 to propagate in much narrower focused beams as compared to audible sound waves that naturally spread out in all directions (e.g., omnidirectional). In some arrangement, the beam of the ultrasonic waves U11, U12, and U13 is converted into a beam of audible sound waves at or adjacent to a single location (e.g., the location L1) as the ultrasonic waves U11, U12, and U13 are demodulated by the air at or adjacent to, for example, the location L1.

In some arrangement, each of the audible sound waves generated at or adjacent to the location L1 has a frequency less than the frequency of any of the ultrasonic waves U11, U12, and U13. In some arrangement, one of the audible sound waves generated at or adjacent to the location L1 may have a frequency substantially equal to a difference between the frequencies of two of the ultrasonic waves U11, U12, and U13. In some arrangement, the ultrasonic waves U11, U12, and U13 all have different frequencies. In some arrangement, the ultrasonic waves U11, U12, and U13 all have different phases and/or amplitudes. In other arrangement, two or more of the ultrasonic waves U11, U12, and U13 may have the same phase and/or amplitude.

Figure 3A:
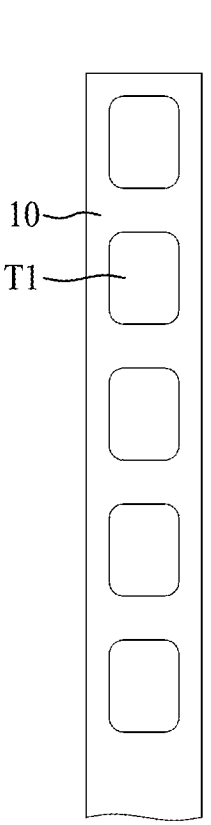
FIG. 3A illustrates a top view of an electronic module, in accordance with some arrangement of the present disclosure.
Figure 3B:
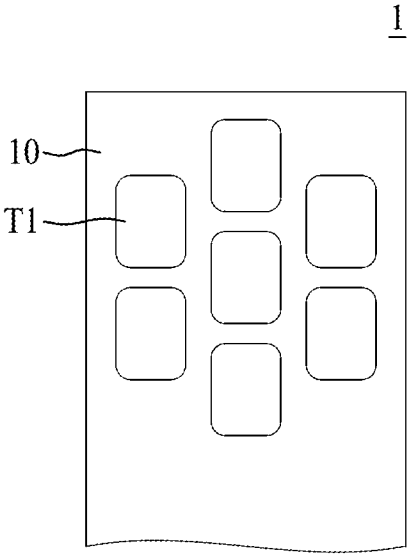
FIG. 3B illustrates a top view of an electronic module, in accordance with some arrangement of the present disclosure.
Figure 3C:
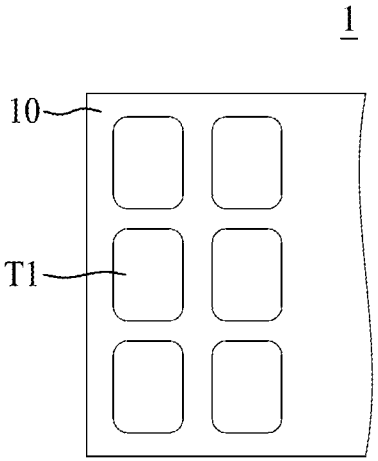
FIG. 3C illustrates a top view of an electronic module, in accordance with some arrangement of the present disclosure.
Figure 3D:
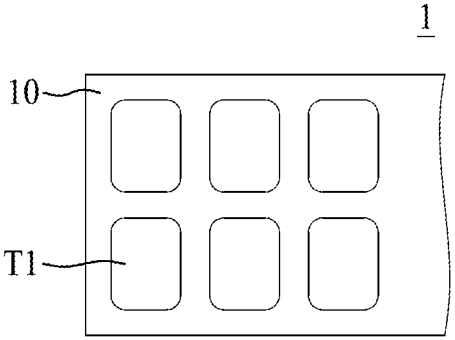
FIG. 3D illustrates a top view of an electronic module, in accordance with some arrangement of the present disclosure.

Although a specific number of transducers is illustrated in FIG. 1, it should be noted that the electronic module 1 may include any number of transducers depending on different requirements. The set of transducers T1 or T2 may be arranged in an M×N array, where M and N are positive integers. For example, as shown in FIG. 3A, which illustrates a top view of the electronic module 1, the set of transducers T1 or T2 includes a 1×5 array. In another example, as shown in FIG. 3C, which illustrates a top view of an electronic module such as the electronic module 1, the set of transducers T1 or T2 includes a 2×3 array. In yet another example, as shown in FIG. 3D, which illustrates a top view of an electronic module such as the electronic module 1, the set of transducers T1 or T2 includes a 3×2 array. In some arrangement, the set of transducers T1 or T2 may include any other arrangements, such as the arrangement shown in FIG. 3B, which illustrates a top view of an electronic module such as the electronic module 1.

One or more electronic components 12 are disposed on the surface 102 of the substrate 10. The electronic components 12 are electrically connected to the substrate 10. The electronic components 12 are electrically connected to the sets of transducers T1 and T2 through, for example, the substrate 10. The electronic component 12 is configured to control the sets of transducers T1 and T2. For example, the electronic components 12 are configured to adjust the frequency, the amplitude, the phase, and/or the emission direction of each of the sonic waves radiated by the sets of transducers T1 and T2. In some embodiments, all the sets of the transducers T1 and T2 can be controlled or adjusted by one electronic component. Alternatively, each of the transducers T11, T12, T13, T21, T22, and T23 can be controlled or adjusted by an individual electronic component.

Each of the electronic components 12 may include an active element or a passive element (e.g., a resistor, a capacitor, an inductor, or a combination thereof). Each of the electronic components 12 may be a chip or a die including a semiconductor substrate, one or more integrated circuit devices and one or more overlying interconnection structures therein. The integrated circuit devices may include active devices such as transistors and/or passive devices such resistors, capacitors, inductors, or a combination thereof. Each of the electronic components 12 may include a processor or a controller, such as a central processing unit (CPU), a microcontroller unit (MCU), an application specific integrated circuit (ASIC), or the like. Each of the electronic components 12 may include a wired or wireless communication module (e.g., Wi-Fi, mobile networks, Bluetooth, near field communication (NFC), or the like) to receive audio data/information to be transmitted through the sets of transducers T1 and T2. Each of the electronic components 12 may include a storage device to store audio data/information to be transmitted through the sets of transducers T1 and T2.

The package body 13 is disposed on the surface 102 of the substrate 10 to cover or encapsulate the electronic component 12. In some arrangement, the package body 13 includes an epoxy resin having fillers, a molding compound (e.g., an epoxy molding compound or other molding compound), a polyimide, a phenolic compound or material, a material with a silicone dispersed therein, or a combination thereof. The package body 13. In some arrangement, the package body 13 includes pliable materials. An outline (or shape) of the package body 13 may be adjustable. For example, the shape of the package body 13 is pliable, flexible, bendable, and/or twistable. For example, the outline of the package body 13 can be adjusted or bent to have a shape that conforms to any structure (e.g., a straight/flat or a non-straight/non-flat structure) of the electrical device.

The electronic module 1 can be integrated within any electrical device which is capable of generating audio information (e.g., sound). Given that the electronic module 1 is pliable, the shape of the electronic module 1 can be suitably adjusted to have any shape according to intended use. The electronic module can conform to any shape of the structure of the electrical device. For example, the electronic module 1 can be applicable to an electrical device such as a smart wearable device (e.g., smart glasses, a smart watch, a smart band, or the like), the shape of which may be suitably adjusted when used or worn by a user to conform to the part of the user on which the electrical device.

In addition, each of the transducers T11, T12, T13, T21, T22, and T23 can be controlled by, for example, the electronic components 12 to radiate audible sonic waves or ultrasonic waves. Therefore, the electrical device having the electronic module 1 can be configured by the electronic components 12 to generate omnidirectional sound waves (e.g., through the set of transducers T2) to be heard by anyone who is around the electrical device regardless of his or her position relative to the electrical device. The electrical device having the electronic module 1 can also be configured by the electronic components 12 to generate the ultrasonic waves (e.g., through the set of transducers T1) to be demodulated into audible sound waves at or adjacent to a desirable location (e.g., the location L1), and thus the demodulated audible sound can be directed toward the ears of a specific user. Given that the shape of the electronic module 1 and the types of sonic waves generated by the transducers T11, T12, T13, T21, T22, and T23 can be easily adjusted, the arrangements disclosed herein allow improved flexibility when designing sound devices.

In some arrangement, all the transducers T11, T12, and T13 (which are configured to radiate ultrasonic waves) can be disposed on a planar surface, and the electronic component 12 can be configured to control the emission direction of the ultrasonic waves radiated by the transducers T11, T12, and T13 so that the ultrasonic waves radiated by the transducers T11, T12, and T13 can be intersected and demodulated. However, frequently adjusting the emission direction of the transducers T11, T12, and T13 by the electronic component 12 would increase the power consumption of the electronic module 1. When such electronic module is integrated into a wearable or portable device (e.g., smart glasses, an earphone, a portable speaker, a smart watch, or the like), the battery of said wearable or portable device cannot last long, which may inconvenience the user.

In accordance with the arrangement shown in FIG. 1, because the substrate 10 is configured to be adjusted so that the transducers T11, T12, and T13 can be disposed on a non-planar surface (e.g., the concave portion 111 of the surface 101), the ultrasonic waves Ulf, U12, and U13 can be intersected naturally without the emission direction of the transducers T11, T12, and T13 being additionally adjusted by the electronic component 12, which can reduce the power consumption of the electronic module 1.

In some arrangement, the electronic module 1 may be formed by the following operations: (i) providing the substrate 10 (e.g., a pliable substrate); (ii) connecting the sets of transducers T1 and T2 on the surface 101 of the substrate 10 through, for example, flip-chip, wire bonding, or any other suitable techniques; (iii) connecting the electronic component 12 on the surface 102 of the substrate 10; and (iv) forming the pliable package body 13 on the surface 102 of the substrate 10 to cover the electronic component 12 by, for example, selective molding or any other molding techniques. In some arrangement, the sequences of the above operations can be changed depending on different design requirements.

Figure 2:
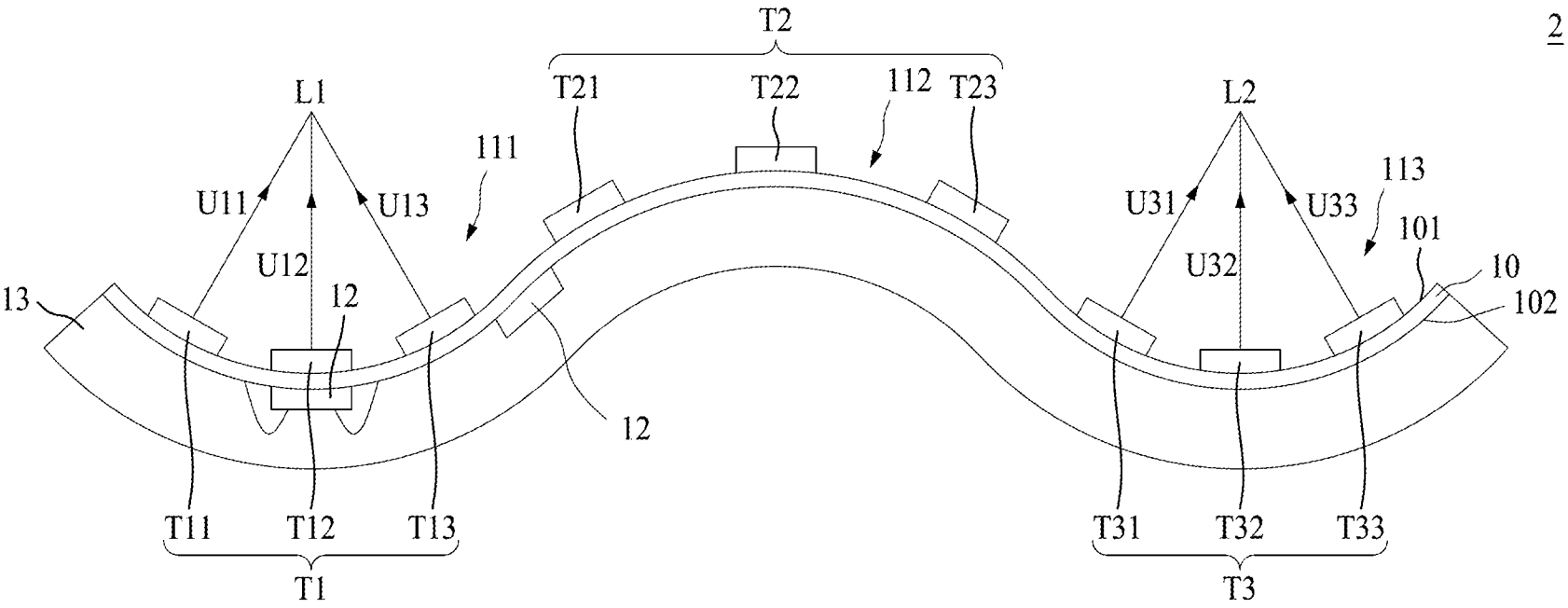
FIG. 2 illustrates a cross-sectional view of an electronic module, in accordance with some arrangement of the present disclosure.

FIG. 2 illustrates a cross-sectional view of an electronic module 2, in accordance with some arrangement of the present disclosure. The electronic module 2 is similar to the electronic module 1, except that the electronic module 2 further includes a set of transducers T3.

As shown in FIG. 2, similar to the set of transducers T1, the set of the transducers T3 (including transducers T31, T32, and T33) is disposed on a concave portion 113 of the surface 101 of the substrate 10. The concave portion 113 of the surface 101 of the substrate 10 on which the set of transducers T3 is disposed is different from the concave portion 111 of the surface 101 of the substrate 10 on which the set of transducers T1 is disposed. In other words, the substrate 10 can be adjusted to have more than one concave portion (and also more than one convex portion). Although a specific number of transducers or a concave/convex portion is illustrated in FIG. 2, is should be noted that the electronic module 2 can include any number of transducers and that the substrate 10 can be adjusted to have any number of concave portions, convex portions or straight portions.

The transducers T31, T32, and T33 (which are located at the concave portion 103 of the surface 101 of the substrate 10) are configured to radiate ultrasonic waves U31, U32, and U33, respectively. In some arrangement, each of the ultrasonic waves U31, U32, and U33 is directional, and the emission directions of the ultrasonic waves U31, U32, and U33 are non-parallel to each other. For example, the ultrasonic waves U31, U32, and U33 may be directed toward a same location (e.g., location L2) and may intersect at said location L2. In some arrangement, the location L2 may be a center of curvature of the concave portion 113 of the surface 101 of the substrate 10. In such arrangements, the lines representing the ultrasonic waves U31, U32, and U33 are radii of the curvature of the concave portion 113 of the surface 101. In other arrangement, the location L2 is different from the center of curvature of the concave portion 113 of the surface 101 of the substrate 10. In some arrangement, each of the ultrasonic waves U31, U32, and U33 is substantially perpendicular to a tangent line of the surface on which the corresponding one of the transducers T31, T32, and T33 is disposed. In other arrangement, each of the ultrasonic waves U31, U32, and U33 is not perpendicular to a tangent line of the surface on which the corresponding one of the transducers T31, T32, and T33 is disposed.

The ultrasonic waves U31, U32, and U33 interfere with each other at or adjacent to a given location, for example, the location L2, similar to the manner in which the ultrasonic waves U11, U12, and U13 interfere with each other at or adjacent to a given location, for example, the location L1. The ultrasonic waves U31, U32, and U33 are demodulated at or adjacent to, for example, the location L2 to form a sonic wave audible to bodies or creatures (e.g., humans or animals). The location L2 is different from the location L1. Therefore, the electronic module 2 is able to generate directional demodulated sound for more than one specific body or user (e.g., two specific users, one user having an ear located at L1 and another user having an ear located at L2) and for more than one ear of the user (e.g., two ears of the user located at L1 and L2).

In some arrangement, the electronic module 2 may be formed by the following operations: (i) providing the substrate 10 (e.g., a pliable substrate); (ii) connecting the sets of transducers T1, T2, and T3 on the surface 101 of the substrate 10 through, for example, flip-chip, wire bonding, or any other suitable techniques; (iii) connecting the electronic component 12 on the surface 102 of the substrate 10 through, for example, flip-chip, wire bonding, or any other suitable techniques; and (iv) forming the pliable package body 13 on the surface 102 of the substrate 10 to cover the electronic component 12 by, for example, selective molding or any other molding techniques. In some arrangement, the sequences of the above operations can be changed depending on different design requirements.

Figure 4:
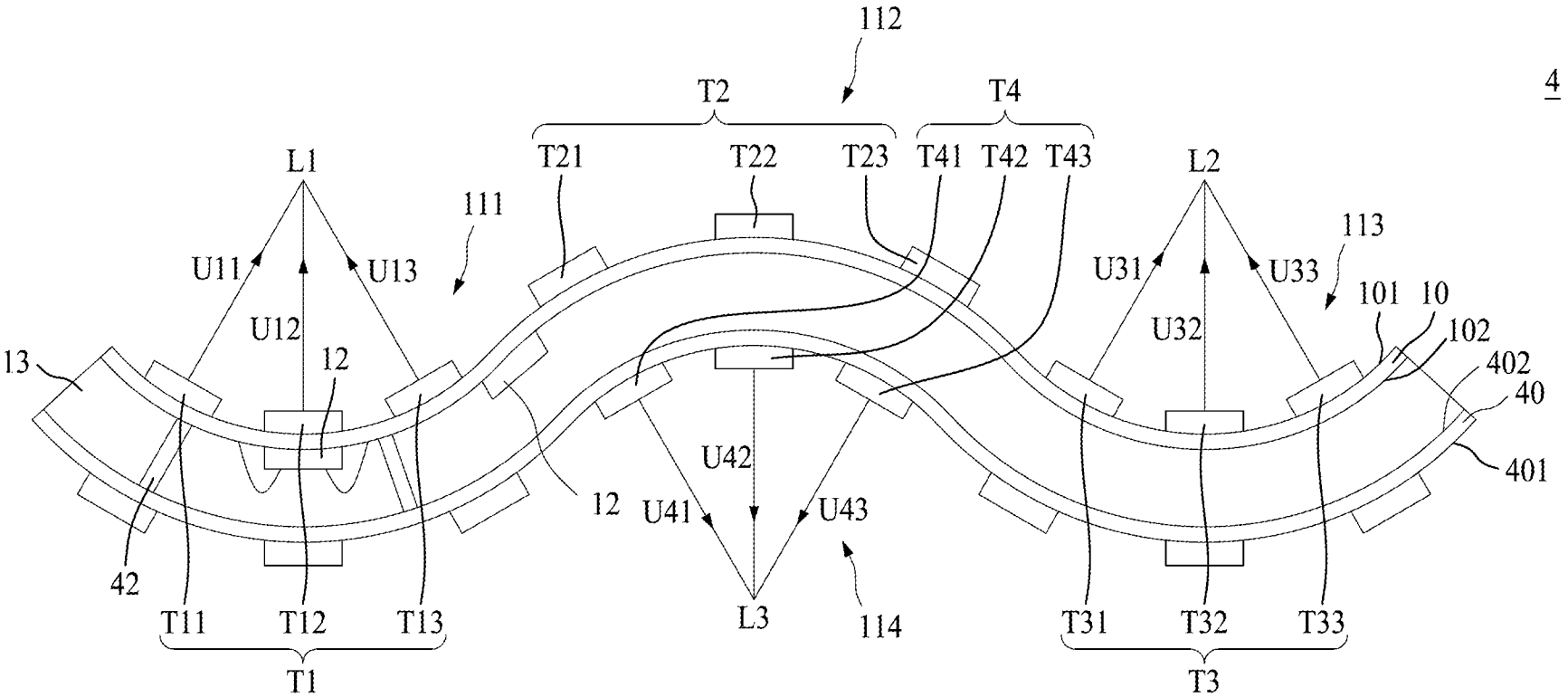
FIG. 4 illustrates a cross-sectional view of an electronic module, in accordance with some arrangement of the present disclosure.

FIG. 4 illustrates a cross-sectional view of an electronic module 4, in accordance with some arrangement of the present disclosure. The electronic module 4 is similar to the electronic module 2, except that the electronic module 4 further includes a substrate 40 and a plurality of transducers including a set of transducers T4.

The substrate 40 and the substrate 10 are disposed on opposite surfaces of the package body 13. The substrate 40 is similar to the substrate 10, and thus the descriptions of the substrate 10 are applicable to the substrate 40. The plurality of transducers including a set of transducers T4 are similar to the sets of transducers T1 and T3, and the description of the sets of transducers T1 and T3 is applicable to the plurality of transducers including a set of transducers T4. The transducers on the substrate 40 may be aligned with the transducers on the substrate 10 depending on different design requirements. For example, as shown in FIG. 4, a same imaginary line extends through the centers of T21 and T41, a same imaginary line extends through the centers of T22 and T42, and a same imaginary line extends through the centers of T23 and T43. Alignment may be consistent regardless of how the shape of the electronic module 4 is being adjusted. Alternatively, the transducers on the substrate 40 may be misaligned with the transducers on the substrate 10 depending on different design requirements. Misalignment may be consistent regardless of how the shape of the electronic module 4 is being adjusted.

Similar to the set of transducers T1 or T3, the set of the transducers T4 (including transducers T41, T42, and T43) is disposed on a concave portion 114 of the surface 401 of the substrate 40. The transducers T41, T42, and T43 are configured to radiate ultrasonic waves U41, U42, and U43, respectively. In some arrangement, each of the ultrasonic waves U41, U42, and U43 is directional, and the emission directions of the ultrasonic waves U41, U42, and U43 are non-parallel to each other. For example, the ultrasonic waves U41, U42, and U43 may be directed toward a same location (e.g., location L3) and may intersect at said location L3. In some arrangement, the location L3 may be a center of curvature of the concave portion of the surface 401 of the substrate 40. In such arrangements, the lines representing the ultrasonic waves U41, U42, and U43 are radii of the curvature of the concave portion 114 of the surface 401. In other arrangement, the location L3 is different from the center of curvature of the concave portion of the surface 401 of the substrate 40. In some arrangement, each of the ultrasonic waves U41, U42, and U43 is substantially perpendicular to a tangent line of the surface on which the corresponding one of the transducers T41, T42, and T43 is disposed. In other arrangement, each of the ultrasonic waves U41, U42, and U43 is not perpendicular to a tangent line of the surface on which the corresponding one of the transducers T41, T42, and T43 is disposed.

The ultrasonic waves U41, U42, and U43 interfere with each other at or adjacent to a given location, for example, the location L3, similar to the manner in which the ultrasonic waves U11, U12, and U13 interfere with each other at or adjacent to a given location, for example, the location L1. The ultrasonic waves U41, U42, and U43 are demodulated at or adjacent to, for example, the location L3 to form a sonic wave audible to bodies or creatures (e.g., humans or animals). The location L3 is different from the location L1 or L2. The location L3 is opposite to the location L1 or L2 with respect to the package body 13. Therefore, the electronic module 4 is able to generate directional demodulated sound for multiple specific bodies or users who are located at opposite sides of a sounding device having the electronic module 4.

In some arrangement, as shown in FIG. 4, the substrate 10 and the substrate 40 is electrically connected with each other by, for example, one or more conductive pillars (or vias, such as through molding vias (TMVs)) 42. For example, the conductive pillars 42 penetrate the package body 13 and electrically connects the substrate 10 with the substrate 40. Therefore, the electronic components 12 can be configured to control the transducers on the substrate 10 and the transducers on the substrate 40. In other arrangement, the conductive pillars 42 may be omitted, and the electronic module 4 may further include another electronic component (not shown) to control the transducers on the substrate 40.

In some arrangement, the electronic module 4 may be formed by the following operations: (i) providing the substrate 10 (e.g., a pliable substrate); (ii) connecting the sets of transducers T1, T2, and T3 on the surface 101 of the substrate 10 through, for example, flip-chip, wire bonding, or any other suitable techniques; (iii) connecting the electronic component 12 on the surface 102 of the substrate 10 through, for example, flip-chip, wire bonding, or any other suitable techniques; (iv); forming the conductive pillars 42 on the surface 402 of the substrate 401 (*v*) forming the pliable package body 13 on the surface 102 of the substrate 10 to cover the electronic component 12 and the conductive pillars 42 by, for example, selective molding or any other molding techniques; (vi) removing a portion of the package body 13 to expose the conductive pillars 42; and (vii) connecting the substrate 40 on which a plurality of transducers including the set of transducers T4 to the package body 13 to be electrically connected to the exposed portion of the conductive pillars 42. In some arrangement, the sequences of the above operations can be changed depending on different design requirements.

Figure 5:
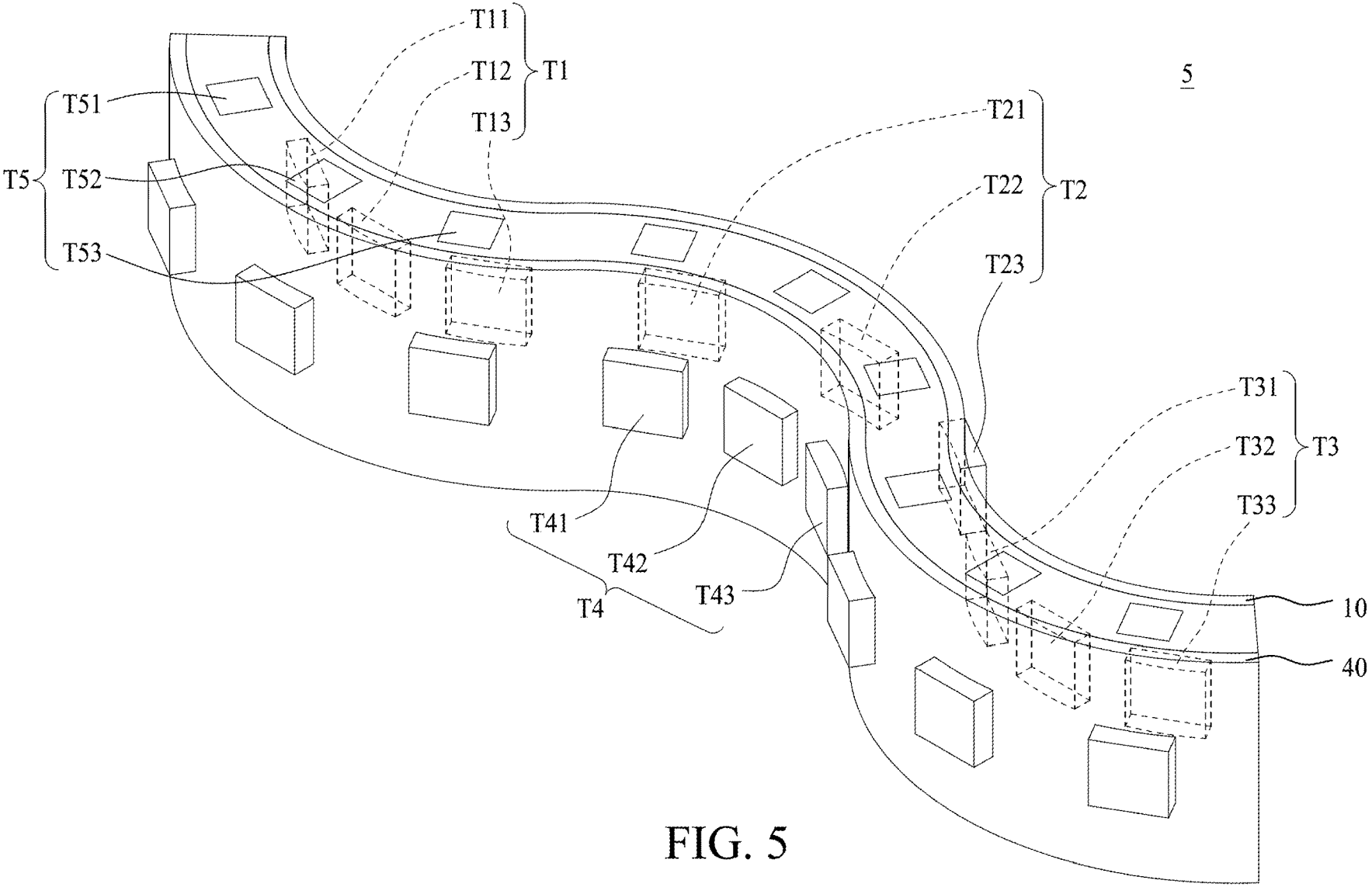
FIG. 5 illustrates a perspective view of an electronic module, in accordance with some arrangement of the present disclosure.

FIG. 5 illustrates a perspective view of an electronic module 5, in accordance with some arrangement of the present disclosure. The electronic module 5 is similar to the electronic module 4, except that the electronic module 5 further includes a plurality of transducers including a set of transducers T5 (including transducers T51, T52, and T53) on a lateral surface extending between the substrate 10 and the substrate 40. The plurality of transducers including a set of transducers T5 are similar to the sets of transducers T1, T2, and T3, and the descriptions of the sets of transducers T1, T2, and T3 can be applicable to the plurality of transducers including a set of transducers T5. Compared with the arrangement as shown in FIG. 4, the electronic module 5 is able to generate directional demodulated sound for more specific users.

Figure 6:
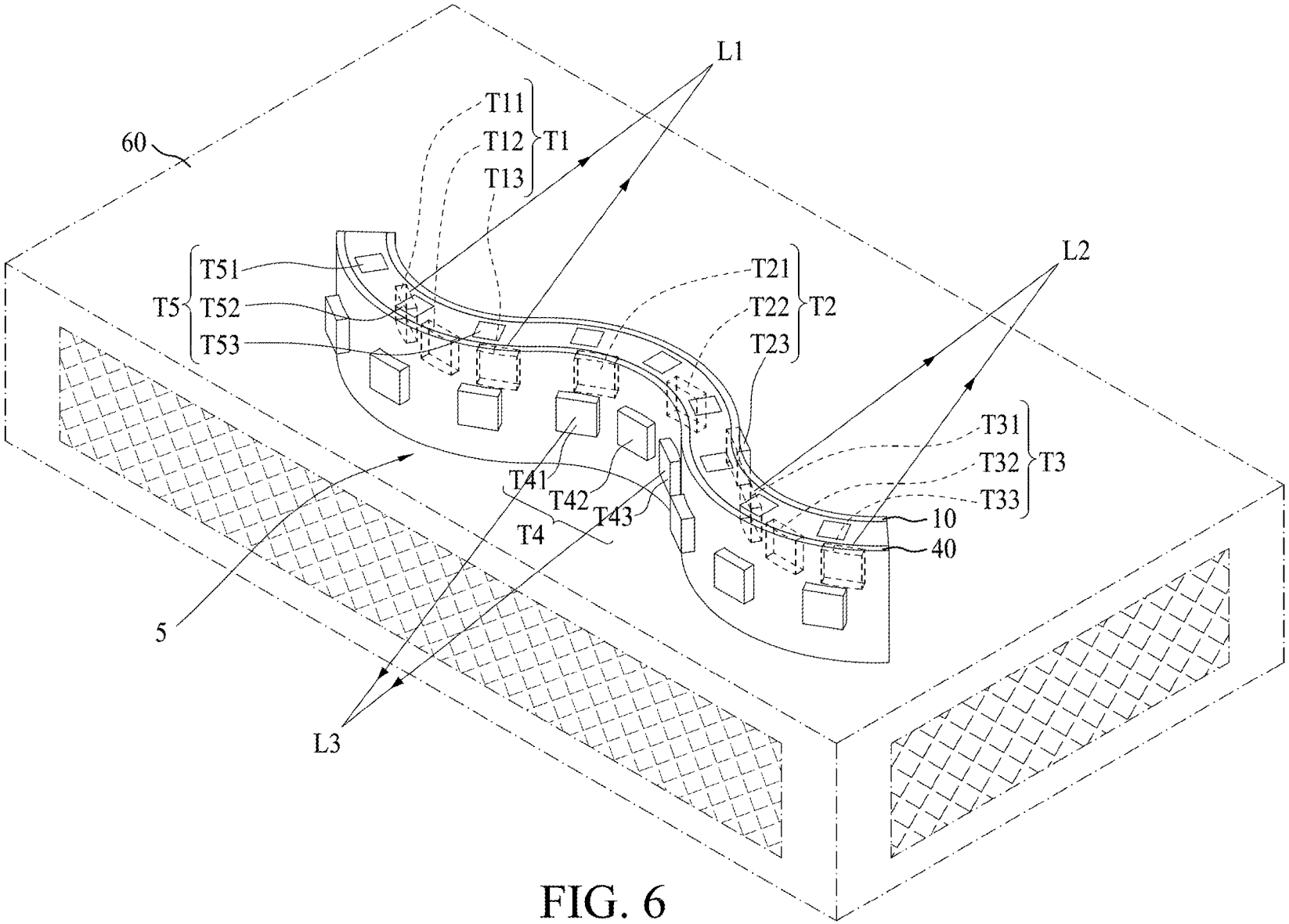
FIG. 6 illustrates a perspective view of an electrical device, in accordance with some arrangement of the present disclosure.

FIG. 6 illustrates a perspective view of an electrical device 6, in accordance with some arrangement of the present disclosure. In some arrangement, the electrical device 6 may be (or include) a speaker (or a soundbox), a telephone, a computer, a notebook, a tablet computer, a cell phone, or any other electrical devices capable of producing sound. The electrical device 6 includes the electronic module 5 as shown in FIG. 5 and a housing (or a cover) 60 to accommodate the electronic module 5. In other arrangement, the electrical device 6 may include the electronic module 1, 2 or 4 as shown in FIG. 1, 2 or 4.

In operation, the electrical device 6 having the electronic module 5 can be configured to generate sound for specific users (e.g., through the sets of transducers T1, T3 and T4) at the locations L1, L2, and L3. The electrical device 6 having the electronic module 5 also can be configured to generate sound for all the users (e.g., through the sets of transducers T2 and T5 around the electrical device 6. Therefore, according to the users' demand, some audio information (e.g., confidential or personal information) can be transmitted to specific users via the sets of transducers T1, T3 and T4, and other audio information (e.g., common or general information) can be transmitted to all the users around the electrical device 6 via the sets of transducers T2 and T5. This can increase the flexibility and practicality of the electrical device 6.

As shown and described herein, the relative positions of any two of the transducers shown in FIGS. 1-6 are adjustable by adjusting the shape of the substrate 10 and the surfaces thereof. For example, an electronic module (e.g., a sounding device) described herein includes an adjustable substrate or carrier (having a shape that is configured to be adjustable), a first transducer configured to radiate a first ultrasonic wave and a second transducer configured to radiate a second ultrasonic wave. A location of the first transducer is configured to be adjustable with respect to the second transducer. The first ultrasonic wave and the second ultrasonic wave are demodulated to form a second sonic wave for a body at a first location. The first transducer and the second transducer are located at a first concave portion of the adjustable carrier. The first ultrasonic wave and the second ultrasonic wave are directionally transmitted in different directions. The electronic module can include a third transducer configured to radiate a first sonic wave audible to a body. The third transducer disposed at a convex portion of the adjustable carrier. A location of the third transducer is configured to be adjustable with respect to the second transducer.

In some examples, the electronic module can include a fourth transducer configured to radiate a fourth ultrasonic wave and a fifth transducer configured to radiate a fifth ultrasonic wave. A location of the fourth transducer is configured to be adjustable with respect to the fifth transducer. The fourth ultrasonic wave and the fifth ultrasonic wave are demodulated to form a third sonic wave audible for a body at a second location different from the first location. The fourth transducer and the fifth transducer are disposed at a second concave portion of the adjustable carrier. In some examples, the first location and the second location are at a same side of the electronic module. In other examples, the first location and the second location are at opposite sides of the electronic module. An electronic component can be implemented to control a frequency, a phase, an amplitude, and/or a radiation direction of each of the transducers. In some examples, the first concave portion and the second concave portion are located at a same side of the adjustable carrier. In other examples, the first concave portion and the second concave portion are located at different sides of the adjustable carrier.

In some implementations, a method for forming a sound wave includes providing an adjustable carrier on which a plurality of transducers are disposed, the transducers configured to generate respective ultrasonic waves and adjusting relative locations of the transducers on the adjustable carrier to form the sound wave demodulated from the ultrasonic waves. The method further includes changing the configuration of the adjustable carrier so that the ultrasonic waves substantially intersect at one or more predetermined locations by manipulating the shape of the carrier (e.g., changing the curvature of the carrier).

As used herein, the terms "substantially," "substantial," "approximately," and "about" are used to denote and account for small variations. For example, when used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. As another example, a thickness of a film or a layer being "substantially uniform" can refer to a standard deviation of less than or equal to ±10% of an average thickness of the film or the layer, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. The term "substantially coplanar" can refer to two surfaces within micrometers of lying along a same plane, such as within 40 μm, within 30 μm, within 20 μm, within 10 μm, or within 1 μm of lying along the same plane. Two surfaces or components can be deemed to be "substantially perpendicular" if an angle therebetween is, for example, 90°±10°, such as ±5°, ±4°, ±3°, ±2°, ±1°, ±0.5°, ±0.1°, or ±0.05°. When used in conjunction with an event or circumstance, the terms "substantially," "substantial," "approximately," and "about" can refer to instances in which the event or circumstance occurs precisely, as well as instances in which the event or circumstance occurs to a close approximation.

As used herein, the singular terms "a," "an," and "the" may include plural referents unless the context clearly dictates otherwise. In the description of some arrangement, a component provided "on" or "over" another component can encompass cases where the former component is directly on (e.g., in physical contact with) the latter component, as well as cases where one or more intervening components are located between the former component and the latter component.

As used herein, the terms "conductive," "electrically conductive" and "electrical conductivity" refer to an ability to transport an electric current. Electrically conductive materials typically indicate those materials that exhibit little or no opposition to the flow of an electric current. One measure of electrical conductivity is Siemens per meter (S/m). Typically, an electrically conductive material is one having a conductivity greater than approximately $10^4$ S/m, such as at least $10^5$ S/m or at least $10^6$ S/m. The electrical conductivity of a material can sometimes vary with temperature. Unless otherwise specified, the electrical conductivity of a material is measured at room temperature.

Additionally, amounts, ratios, and other numerical values are sometimes presented herein in a range format. It can be understood that such range formats are used for convenience and brevity, and should be understood flexibly to include not only numerical values explicitly specified as limits of a range, but also all individual numerical values or sub-ranges encompassed within that range as if each numerical value and sub-range is explicitly specified.

While the present disclosure has been described and illustrated with reference to specific arrangement thereof, these descriptions and illustrations do not limit the present disclosure. It can be clearly understood by those skilled in the art that various changes may be made, and equivalent elements may be substituted within the arrangement without departing from the true spirit and scope of the present disclosure as defined by the appended claims. The illustrations may not necessarily be drawn to scale. There may be distinctions between the artistic renditions in the present disclosure and the actual apparatus, due to variables in manufacturing processes and such. There may be other arrangement of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it can be understood that these operations may be combined, sub-divided, or re-ordered to form an equivalent method without departing from the teachings of the present disclosure. Therefore, unless specifically indicated herein, the order and grouping of the operations are not limitations of the present disclosure.

What is claimed is:

1. An electronic module, comprising:

a first substrate having a first surface and a second surface opposite to the first surface;

a first transducer disposed over the first surface of the first substrate and configured to radiate a first ultrasonic wave; and a second transducer disposed over the first surface of the first substrate and configured to radiate a second ultrasonic wave;

an electronic component disposed over the second surface of the first substrate; and a package body disposed over the second surface of the first substrate to encapsulate the electronic component, wherein a location of the first transducer is configured to be adjustable with respect to the second transducer to form a first audible sonic wave by demodulating the first ultrasonic wave and the second ultrasonic wave.

2. The electronic module of claim 1, wherein the electronic component and the first transducer are at least partially overlapped along a direction substantially perpendicular to a tangent line of a concave portion of the first substrate.

3. The electronic module of claim 2, wherein a center of the electronic component and a center line of the first transducer are substantially aligned.

4. The electronic module of claim 1, further comprising:

a second substrate, wherein the first substrate and the second substrate are disposed over opposite sides of the package body.

5. The electronic module of claim 4, further comprising:

a conductive pillar penetrating the package body and electrically connected with the first substrate and the second substrate.

6. The electronic module of claim 4, wherein a first lateral surface of the first substrate, a first lateral surface of the second substrate, and a first lateral surface of the package body are substantially aligned.

7. The electronic module of claim 6, wherein the first substrate comprises a second lateral surface angled with the first lateral surface of the first substrate, the second substrate comprises a second lateral surface angled with the first lateral surface of the second substrate, and the package body comprises a second lateral surface angled with the first lateral surface of the package body; wherein the second lateral surface of the first substrate, the second lateral surface of the second substrate, and the second lateral surface of the package body are substantially aligned.

8. The electronic module of claim 1, further comprising:

at least a third transducer disposed over a lateral surface of the package body.

9. The electronic module of claim 8, wherein the at least a third transducer is configured to radiate an audible sonic wave.

10. The electronic module of claim 8, wherein the third transducer is spaced apart from the first substrate and the second substrate.

11. The electronic module of claim 1, further comprising:

a second substrate, wherein the first substrate and the second substrate are disposed over opposite sides of the package body;

a third transducer disposed over a lateral surface of the package body, wherein the electronic component and the first transducer are at least partially overlapped along a direction substantially perpendicular to a tangent line of a concave portion of the first substrate.

12. An electronic module, comprising:

a first set of transducers disposed over a first surface of the electronic module and configured to radiate ultrasonic waves, wherein a location of each of the first set of transducers is adjustable with respect to other transducers of the first set of transducers to form a first audible sonic wave by demodulating the ultrasonic waves radiated by the first set of transducers;

a second set of transducers disposed over a second surface of the electronic module opposite to the first surface and configured to radiate second audible sonic waves; and a third set of transducers disposed over a third surface of the electronic module extending between the first surface and the second surface, wherein the third set of transducers are configured to radiate third audible sonic waves, wherein the first surface and the second surface of the electronic module have substantially the same curvature, and wherein a location of each of the second set of transducers is adjustable to disperse the second audible sonic waves radiated by the second set of transducers.

13. The electronic module of claim 12, further comprising:

an electronic component embedded in the electronic module.

14. The electronic module of claim 12, further comprising:

a housing accommodating the electronic module, wherein the first set of transducers are configured to radiate a first ultrasonic wave and a second ultrasonic wave demodulated outside of the housing.

* * * * *